US005252375A

United States Patent [19]

Turbak et al.

[11] Patent Number: 5,252,375

[45] Date of Patent: Oct. 12, 1993

[54] PERMANENT STAIN RESISTANT TREATMENT FOR POLYAMIDE FIBERS

[75] Inventors: Albin F. Turbak, Sandy Springs; Rodney A. Smith, Smyrna; Chung-Hsien Zah, Kennesaw, all of Ga.

[73] Assignee: Interface, Inc., Atlanta, Ga.

[21] Appl. No.: 660,919

[22] Filed: Feb. 27, 1991

Related U.S. Application Data

[63] Continuation-in-part of Ser. No. 497,893, Mar. 22, 1990, abandoned.

[51] Int. Cl.[5] ..... B32B 3/02

[52] U.S. Cl. ..... 428/96; 8/115.67; 427/393.4; 428/423.5

[58] Field of Search ..... 8/560, 115.67; 427/389.9, 393.4; 428/96, 97, 423.5

[56] References Cited

U.S. PATENT DOCUMENTS

| | | | |
|---|---|---|---|
| 3,406,005 | 10/1968 | Whitfield et al. | 8/115.5 |
| 4,190,599 | 2/1980 | Richter et al. | 528/59 X |
| 4,195,105 | 3/1980 | Mares et al. | 427/386 |
| 4,410,689 | 10/1983 | Barsa et al. | 528/367 |
| 4,507,324 | 3/1985 | Olive et al. | 428/325 |
| 4,530,859 | 7/1985 | Grunzinger, Jr. | 427/385.5 |
| 4,672,094 | 6/1987 | Nelb, II et al. | 525/440 |
| 4,892,558 | 1/1990 | Blyth et al. | 8/560 |
| 4,940,047 | 7/1990 | Richter et al. | 128/90 |

FOREIGN PATENT DOCUMENTS

| | | |
|---|---|---|
| 89307682.8 | 1/1990 | European Pat. Off. . |
| 3516089 | 11/1986 | Fed. Rep. of Germany . |
| 40-61118 | 9/1965 | Japan . |
| 60-93065 | 4/1985 | Japan . |

OTHER PUBLICATIONS

Kondo, et al., *The Chemical Society of Japan*, 9, 1459 (1984).

Tenchev, et al., *Mater. Plast.* (Bucharest) 18(2), 108–112 (1981).

Nikolayev, et al., *Viniti*, 3373–77 (1977).

*Primary Examiner*—Michael Lusigan

*Attorney, Agent, or Firm*—Kilpatrick & Cody

[57] ABSTRACT

A method to impart permanent stain resistance to polyamides, including nylon fiber and fibrous articles such as carpet and carpet tile, that includes treating the fiber with an isocyanate under moderate conditions that do not damage other materials that the fiber is attached to. Nylon carpet and carpet tile treated according to this method are highly suited for commercial use because they retain their stain resistance after repeated washings.

38 Claims, 1 Drawing Sheet

3-Isocyanatomethyl-3,5,5-trimethylcyclohexyl isocyanate (IPDI)

4,4'-Diphenylmethane diisocyanate (MDI)

a,a-Dimethyl meta-isopropenyl benzyl isocyanate (TMI)

3-Isocyanatomethyl-3,5,5-trimethylcyclohexyl isocyanate (IPDI)

4,4'-Diphenylmethane diisocyanate (MDI)

a,a-Dimethyl meta-isopropenyl benzyl isocyanate (TMI)

PERMANENT STAIN RESISTANT TREATMENT FOR POLYAMIDE FIBERS

This is a continuation-in-part of application Ser. No. 07/497,893, filed Mar. 22, 1990, now abandoned.

BACKGROUND OF THE INVENTION

This invention is a method to impart permanent stain resistance to polyamide fibers.

Polyamide fibers are found in a wide variety of commercially important textile materials, including nylon, silk, wool, and leather. It is estimated that 75% of all carpet currently produced in the United States, and 46% of all carpet produced in Europe, is prepared from nylon fiber. Nylon fiber is also used extensively in upholstery and fabric coverings.

One disadvantage in using nylon, as well as other polyamide fibers, as the pile yarn in carpet or as a constituent in fabric is that the fiber is easily stained by many materials. In fact, it has been determined that more carpets are replaced because of staining than because the fibers are worn. The most significant mechanism of action of staining of nylon fiber appears to involve the formation of ionic bonds between protonated terminal amine groups on the polyamide fiber and anionic materials such as acid dyes. Common substances that contain acid dyes include mustard, wine, and soft drinks that contain FD&C red dye No. 40 (such as cherry Kool Aid ®).

The most common approach to increasing the resistance to staining of polyamide fibers has been to treat the fibers with a colorless formaldehyde aromatic condensation polymer that has sulfonate groups on the aromatic rings. The condensation polymers are typically prepared from 4,4'-dihydroxydiphenylsulfone (also referred to as 4,4'-sulfonylbisphenol or DDS), phenyl 4-sulfonic acid, naphthalene sulfonic acid or 2,4-dimethylbenzene sulfonic acid. The sulfonate groups ionically bond to available protonated amino groups in the polyamide fiber, preventing the protonated amino groups from later bonding to commonly used acid dyes.

Examples of methods to impart stain resistance to nylon fibers that include the use of a sulfonated condensation polymer are described in U.S. Pat. No. 4,839,212 to Blythe (disclosing nylon carpet fibers, coated with a sulfonated aromatic condensation polymer, that resist staining by acid dyes at room temperature but are dyeable at elevated temperatures); U.S. Pat. No. 4,501,591 to Ucci, et al. (disclosing the use of sulfonated phenol-formaldehyde condensation polymers in combination with alkali metal silicates to impart stain resistance to nylon fibers); and U.S. Pat. Nos. 4,592,940 and 4,680,212 to Blythe, et al. (disclosing formaldehyde condensation products formed from a mixture of sulfonated dihydroxydiphenylsulfone and phenylsulphonic acid, wherein at least 40% of the repeating units contain an $—SO_3X$ radical, and at least 40% of the repeating units are dihydroxydiphenylsulfone).

U.S. Pat. No. 4,699,812 to Munk discloses a method for imparting stain resistance to nylon fibers that includes applying a solution of an aliphatic sulfonic acid containing 8 to 24 carbon atoms under acidic conditions.

In a variation of these methods, the sulfonated formaldehyde condensation polymers have been blended with other polymers to increase the effectiveness of stain resistance. For example, U.S. Pat. No. 4,822,373 to Olson discloses a method of imparting stain resistance to nylon fiber that includes applying a mixture of a partially sulfonated novolac resin and a polymethacrylic acid.

European Patent Application No. 88311826.7 filed by E. I. Du Pont Nemours and Company describes stain resistant polyamide fibers prepared by treating the fiber with a hydrolyzed ethylenically unsaturated aromatic maleic anhydride polymer in combination with a sulfonated aromatic condensation polymer.

Although polyamide fibers treated with sulfonated condensation polymers have improved resistance to staining by acid dyes, the resistance is reduced or eliminated after several shampooings, because the sulfonated aromatic condensation polymers are stripped from the fiber. Regardless of the effectiveness of a sulfonated material in imparting stain resistance to polyamides, after several shampooings, the polyamide is just as susceptible to staining as before treatment. This is particularly disadvantageous in a commercial or industrial setting, because of the need for frequent cleaning.

Not only are polyamide fibers easily stained by anionic materials, they are also soiled easily. Fluorochemicals are typically used to reduce the tendency of soil to adhere to the fiber surface, and reduce fiber wettability. Fluorochemicals also provide a physical barrier to the staining material. Examples of commercially available fluorochemical coatings include Scotchgard ® 358 and 352 (Minnesota Mining & Mfg. Co.) and Zepel ® and Teflon ® (E. I. Du Pont Nemours & Co.). Antron Plus ® carpet manufactured by Du Pont contains nylon carpet fibers coated with fluorocarbons. However, fluorochemical coatings alone provide no resistance to staining by acid dyes.

There is a need for a convenient method to impart permanent stain resistance to polyamide fibers that is appropriate for industrial use.

Therefore, it is an object of the present invention to provide a method to impart stain resistance to natural or synthetic polyamide fibers that will not be removed on washing the fiber.

It is another object of the present invention to provide a method for treating natural or synthetic polyamide fiber that is mild enough not to damage other materials attached to the fiber.

It is still another object of the present invention to provide a method to impart permanent stain resistance to nylon carpet and carpet tile for commercial or industrial use.

It is yet another object of the present invention to provide a method to impart permanent stain resistance to natural or synthetic polyamide fabric.

It is a further object of the present invention to provide nylon carpet tile that is permanently stain resistant.

SUMMARY OF THE INVENTION

The present invention is a method to impart permanent stain resistance to polyamide fibers that includes treating the fiber with an isocyanate under moderate conditions that do not damage other materials that the fiber is attached to. The invention provides nylon carpet and carpet tile that are highly suited for commercial use because they retain their stain resistance after repeated washings.

According to the invention, the terminal amine group of the polyamide fiber is reacted with a monoisocyanate, a diisocyanate, a polyisocyanate, or an oligomer or polymer containing isocyanate functional groups, or a combination of these, to produce a terminal substituted urea. The fiber can be treated before or after manufacture into an article such as fabric, carpet, or carpet tile. The fiber can be coated with a fluorocarbon after or during isocyanate treatment.

Treatment of polyamide fiber with an isocyanate provides a stain resistance that is significantly better than that provided by sulfonated aromatic condensation products now marketed for this purpose, because the protection provided by isocyanate treatment is permanent. The treatment is effective after extensive washings and even after extraction with hot ethanol. By comparison, the present stain resist treatments for nylon fibers are stripped from the fiber after repeated washing or extraction with ethanol.

Samples of nylon 6 fiber treated with isocyanate resist staining after being soaked overnight in cherry Kool Aid ® at room temperature, or after heating the fiber in cherry Kool Aid ® at 100° C. for two hours. In comparison, untreated nylon fiber resists staining by cherry Kool Aid ® at room temperature for approximately five minutes.

The isocyanate can be effectively applied to any synthetic or natural fiber having terminal amine groups using a wide variety of means. In the preferred method, the fiber or fibrous article is treated with a foam or spray of isocyanate, and then passed through a heating unit. In another embodiment, the fiber or fibrous article is soaked in the isocyanate and then heated until dry. Alternatively, the isocyanate can be applied by pad squeeze or kiss roll. The length of time and temperature needed to dry the fiber or article will vary depending on the type of oven and the solvent system used to apply the isocyanate. A drying temperature should be chosen that does not damage the fiber or any materials in the fibrous article.

DETAILED DESCRIPTION OF THE INVENTION

Figure 1:
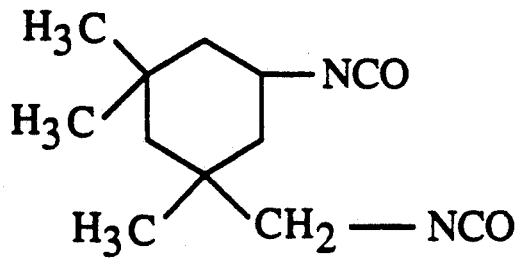
FIG. 1 is an illustration of the chemical structures of a,a-dimethyl meta-isopropenyl benzyl isocyanate (TMI), 4,4'-diphenylmethane diisocyanate (MDI), and 3-isocyanatomethyl-3,5,5-trimethylcyclohexyl isocyanate (IPDI, also called isophorone diisocyanate).
Figure 1:
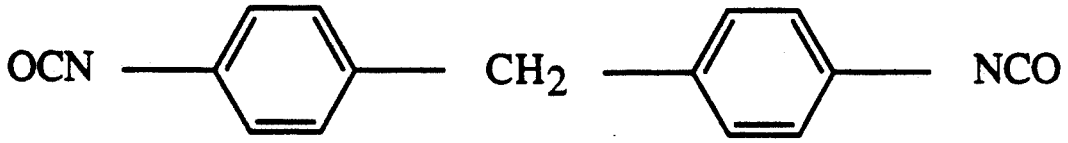
Figure 1:
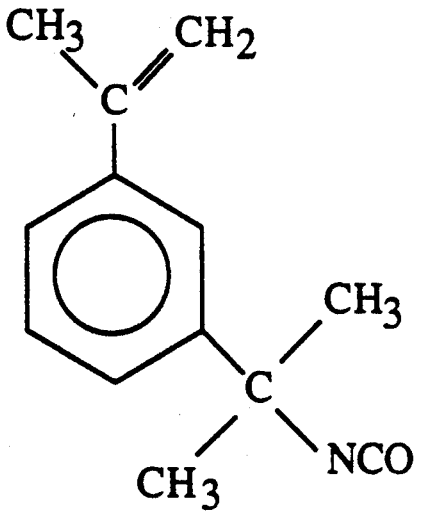

Isocyanates can be used to impart permanent stain resistance to any fiber that has reactive terminal amino groups, for example, polyamides. As used below, the term polyamide includes homopolymers or copolymers that contain polyamide linkages. Polyamides are found in a wide variety of fibers and fabrics, such as wool, silk, natural leather, synthetic leather and nylon.

Nylon is a synthetic polyamide prepared by the polycondensation of a dicarboxylic acid and a diamine, such as adipic acid and hexamethylene diamine (nylon 6,6), or from a diisocyanate and a dicarboxylic acid. In manufacturing nylon from a diamine and a dicarboxylic acid, an excess of diamine can be used to produce a fiber that has two terminal amine groups instead of a terminal amine and a terminal carboxylic acid. An excess of amine is typically used to increase the acid dyeability of the fiber. This process, however, can also increase the tendency of the fiber to stain. Nylon can also be produced from a cyclic amide such as caprolactam (nylon 6).

As used herein, the term "isocyanate" refers to any compound that has at least one isocyanate functional group, including but not limited to monoisocyanates, diisocyanates, polyisocyanates, and polymers containing isocyanate functional groups.

Polyamides are known to react with isocyanates to form substituted ureas, and have been so reacted in the past to alter properties other than stain resistance. Kondo, et al., *The Chemical Society of Japan* 9, 1459 (1984) report that the surface of a nylon film can be made soil (water and oil) resistant by refluxing it for fourteen hours with p-(perfluorononyl)phenyl isocyanate. The length of treatment is unsuitable for an industrial procedure and can result in undesirable side reactions if any other material is attached to the fiber. U.S. Pat. 4,672,094 discloses that a polyamide can be reacted with an organic diisocyanate to increase the molecular weight of a polyamide prepared from a diisocyanate and a dicarboxylic acid. Tenchev, K. H., et al., *Mater. Plast.* (*Bucharest*) 18(2), 108–112 (1981) describes the modification of polyamide tire cord with isocyanates to alter the relative elongation, tensile strength, and crystallinity of the cord. Nikolaev, V. N., et al., *Viniti* 3373–77 (1977) discloses that the modification of polyamide fabric with a diisocyanate improves thermostability and adhesion properties. German Patent Application DE 3526272 discloses that modification of polyamides with monoisocyanates increases fold capability, mold release behavior and notch impact strength. Japanese Patent Application 60-93065 describes polyamide resins suitable for use as insulator materials such as wire coatings prepared by reacting 0.5–2.0 isocyanate radicals for each amide moiety in the polyamide chain. None of these references provide a method to increase the stain resistance of polyamide fibers

I. Capping

In one embodiment, the disclosed invention is a method to impart permanent stain resistance to polyamide fibers that includes treating the fiber with a monoisocyanate that covalently binds to the terminal amine group of the polyamide to form a terminal substituted urea, according to the following equation:

$$R{-}N{=}C{=}O + R'{-}NH_2 \longrightarrow R{-}\overset{H}{\overset{|}{N}}{-}\overset{O}{\overset{\|}{C}}{-}\overset{H}{\overset{|}{N}}{-}R'$$

wherein

R is any hydrocarbon or substituted hydrocarbon in an isocyanate that is capable of forming a stable bond with the terminal amine and that does not participate in undesirable side reactions; and R' the polyamide chain that terminates with the reactive amine. The fiber can be treated with a homogeneous solution of monoisocyanate, or with a mixture of isocyanates.

R is defined functionally to emphasize that the invention is not restricted to the use of a certain family of monoisocyanates, but rather, lies in the permanent "capping" of the terminal amine of the polyamide with any suitable isocyanate.

The choice of isocyanate will determine in part how the fiber is treated; for example, whether the isocyanate can be applied in an aqueous solution, an emulsion, or in an organic solvent. The choice of isocyanate will also determine the treatment conditions. For example, aliphatic isocyanates react with terminal amines more slowly than aromatic isocyanates, and therefore may require more vigorous application conditions. Further, it has been discovered that aliphatic isocyanates have less tendency to yellow than aromatic isocyantes after incorporation into the fiber. Aromatic isocyanates, however, tend to provide superior stain resistance.

Preferably, R is an aromatic, heterocyclic, aliphatic, araliphatic, alkaryl, or cycloaliphatic group of $C_1$ to $C_{24}$, optionally with hetero (O,S, or N) or CONH linkages, and optionally substituted with chlorine, bromine, or fluorine. The term aliphatic includes alkanes, alkenes, and alkynes.

Examples of suitable monoisocyanates include a,a-dimethyl meta-isopropenyl benzyl isocyanate (TMI, available from American Cyanamid Company, see FIG. 1), phenyl isocyanate, cyclohexyl isocyanate, octyl isocyanate, hexyl isocyanate, 2-ethylhexyl isocyanate, 2,3,4-trimethylcyclohexyl isocyanate, 3,3,5-trimethyl isocyanate, decyl isocyanate, 2-norbornyl-methyl isocyanate, dodecyl isocyanate, tetradecyl isocyanate, hexadecyl isocyanate, octadecyl isocyanate (stearic isocyanate), oleic isocyanate, 3-butoxypropyl isocyanate, toluyl isocyanate, chlorophenyl isocyanate, dichlorophenyl isocyanate, benzyl isocyanate, and 1-naphthyl isocyanate.

The monoisocyanates can be purchased commercially or can be synthesized by methods known to those skilled in the art, for example, by the reaction of phosgene with the desired amine.

Isocyanates do not react appreciably with the amide linkages of the polyamide fibers under the conditions described here to treat the fiber, because the amide nitrogen is significantly less reactive than the nitrogen in the terminal amine groups.

In a preferred embodiment, the isocyanate that is reacted with the polyamide fiber has a sufficiently low molecular weight that it penetrates to some extent into the fiber before reaction. Monomers and oligomers of up to ten monomers can typically penetrate the fiber with ease. The optimal molecular weight of the isocyanate will depend on the porosity and nature of the fiber. The optimal isocyanate treatment provides a dense protective layer at and closely below the surface.

II. Chain Extension

In an alternative embodiment, terminal amine groups of a polyamide fiber can be permanently linked by reaction with a diisocyanate according to the equation:

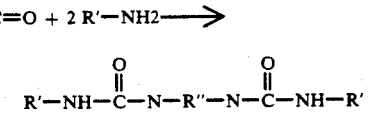

wherein

R'' is any hydrocarbon or substituted hydrocarbon in a diisocyanate that is capable of forming stable bonds with the terminal amine and that does not participate in undesirable side reactions; and R' is the polyamide chain that terminates with the reactive amine.

As above, R'' is defined functionally to emphasize that the invention is not restricted to a certain family of diisocyanates, but instead covers within its scope the use of any diisocyanate that will crosslink with the terminal amine groups to form permanent bonds that protect the fiber from acid dyes.

Preferably, R'' an aromatic, heterocyclic, aliphatic, araliphatic, alkaryl, or cycloaliphatic group of $C_1$ to $C_{24}$, optionally with hetero (O,S, or N) or CONH linkages, and optionally substituted with chlorine, bromine, or fluorine.

Examples of suitable diisocyanates include 4,4'-diphenylmethane diisocyanate (MDI, available from ICI Polyurethanes Group, West Deptford, New Jersey, see FIG. 1); PBA 2259 (a more stable water dispersible version of MDI also available from ICI Polyurethanes Group); 3-isocyanatomethyl-3,5,5-trimethylcyclohexyl isocyanate (IPDI, or isophorone diisocyanate, available from Huls America, Inc., see FIG. 1); toluene diisocyanate (TDI); hexamethylene diisocyanate, octamethylene diisocyanate, decamethylene diisocyanate, cyclohexyl diisocyanate, methylenebis-(4-cyclohexylisocyanate), phenylene diisocyanate, diphenylether-4,4'-diisocyanate, xylene diisocyanate, tetramethyl xylene diisocyanate, polyether diisocyanate, polyester diisocyanate, polyamide diisocyanate, and dimer acid diisocyanate (a diisocyanate prepared from the reaction product of two unsaturated carboxylic acids).

The use of multifunctional isocyanates, such as triisocyanates and tetraisocyanates to impart stain resistance to nylon fibers is also considered within the scope of this invention.

III. Use of Oligomeric and Polymeric Isocyanates

The stain resistance of a polyamide fiber can also be enhanced by reaction with a polymer that has isocyanate functional groups. Suitable polymers include those with aromatic or aliphatic backbones, for example, Desmodour E-14 from Mobay Corporation.

Isocyanate functionalized polymers also provide a protective coating for the polyamide fiber. If the functionalized polymer is water repellent, for example, if it is halogenated, it will decrease the tendency of soil or liquid to adhere to the fiber surface. A water soluble isocyanate can be prepared by reacting a diisocyanate with a perfluorinated alcohol. An example is the reaction of MDI with ½ of an equivalent of perfluorononyl alcohol. Alternatively, a polymer can be selected that imparts anti-static qualities.

IV. Use of Isocyanate Precursors

The isocyanate can be reacted with the polyamide fiber in a blocked or masked form, or in a mixture that includes unblocked and blocked derivatives. Methods for blocking isocyanates are described in U.S. Pat. No. 4,530,859, incorporated herein by reference; Doyle, "The Development and Use of Polyurethane Products," McGraw-Hill (1971); and Saunders and Frisch, "Polyurethanes: Chemistry and Technology," Part II, Interscience (New York 1964), pages 8–49.

Typical blocking agents include phenol type blocking agents, including phenol, cresol, xylenol, nitrophenol, chlorophenol, ethylphenol, t-butylphenol, hydroxybenzoic acid, hydroxybenzoic acid esters, and 2,5-di-tert-butyl-4-hydroxytoluene;

lactam type blocking agents, including ε-caprolactam, δ-valerolactam, butyrolactam, and β-propiolactam;

active methylene type blocking agents, including diethyl malonate, dimethyl malonate, ethyl acetoacetate, methyl acetoacetate, acetylacetone, and t-butylacetoacetate;

alcohol type blocking agents, including hexane diol, ethylene glycol, methanol, ethanol, n-propyl alcohol, isopropyl alcohol, n-butyl alcohol, isobutyl alcohol, t-butyl alcohol, n-amyl alcohol, t-amyl alcohol, lauryl alcohol, ethylene glycol monoether, diethylene glycol monomethyl ether, propylene glycol monomethyl ether, methoxymethanol, glycolic acid, glycolic acid esters, lactic acid, lactic acid esters, methylol urea, methylol melamine, diacetone alcohol, ethylene chlorohydrin, ethylene bromohydrin, 1,3-dichloro-2-propanol, and acetocyanohydrin;

mercaptan type blocking agents, including butylmercaptan, hexylmercaptan, t-butylmercaptan, t-dodecylmercaptan, 2-mercaptobenzothiazole, thiophenol, methylthiophenol, and ethylthiophenol;

acid amide type blocking groups, including acetoanilide, acetoacetanisidide, acetotoluide, acrylamide, methacrylamide, acetamide, stearylamide, and benzamide;

imide type blocking agents, including succinimide, phthalimide, and maleimide;

amine type blocking agents, including diphenyl amide, phenolnaphthyl amide, zylidine, N-phenylzylidine, carbazole, aniline, naphthyl amide, butyl amine, dibutyl amine, and butylphenyl amide;

imidazole type blocking agents, including imidazole, and 2-ethylimidazole;

urea type blocking agents, including urea, thiourea, ethylene urea, ethylene thiourea, and 1,3-diphenylurea;

carbamate type blocking agents, including phenyl N-phenylcarbamate, and 2-oxazolidone;

imine type blocking agents, including ethyleneimine;

oxime type blocking agents, including formaldoxime, acetaldoxime, acetoxime, methylethylketoxime, dioctyl monoxime, benzophenone oxime, and cyclohexanone oxime; and sulfite type blocking agents, including sodium bisulfite and potassium bisulfite.

For example, the reaction of an alcohol with an isocyanate produces a urethane. This reaction is reversible. Heat forces the equilibrium back toward formation of the isocyanate. When the temperature rises above 100° C., the water in the solution is evaporated, and the isocyanate is forced to react with the polyamide terminal amine, which is easily reversible, or the alcohol, which again is a reversible reaction.

It is important to choose a blocked isocyanate that generates a free isocyanate at a temperature below which the fiber or fibrous article to be treated is damaged. The suitability of a desired blocked isocyanate can be determined easily by a small scale trial run carried out according to procedures described in Section V.

Molecules that are capable of thermal rearrangement to isocyanates are also suitable to impart stain resistance to polyamides. For example, U.S. Pat. Nos. 4,109,599 and 4,410,689, incorporated herein by reference, disclose bis-cyclic ureas that rearrange to aliphatic diisocyanates.

Oligomers of aromatic diisocyanates can be prepared by reacting an excess of diisocyanate with a diol such as hexane diol or ethylene glycol to form a urethane. This urethane can be used as a precursor to the diisocyanate in polyamide fiber treatment. The urethane can be prepared in advance or formed in situ. It is preferred to have the ratio of diol to diisocyanate below 1:1 so that an oligomer is formed with terminal isocyanate groups, and not terminal hydroxyl groups. The most preferred range is 0.3 or less diol to isocyanate. The diol can be fluorinated or optionally substituted with groups that do not interfere with the isocyanate reaction.

Aliphatic isocyanates typically react slowly with blocking agents, and will only form useful oligomers in situ with the use of catalysts.

V. Treatment of the Polyamide Fiber with the Isocyanate

The desired isocyanate can be effectively applied to any synthetic or natural polyamide fiber using a wide variety of means, for example, in a batch system, a pad squeeze or a kiss roll coating. The isocyanate can also be effectively applied as a foam or in a spray. Alternatively, the isocyanate can be applied by dipping the fiber into an isocyanate solution.

In the preferred method to impart superior and permanent resistance to common staining materials such as FD&C No. 40 (the staining component of cherry Kool Aid ®), wine, and mustard with tumeric, the polyamide fiber is treated with an isocyanate before it is dyed or manufactured into fabric or carpet. This procedure allows for thorough treatment of the fiber and avoids the problem of interfering additives or coatings applied during manufacture. However, after the fiber has been treated with an isocyanate, it will not be susceptible to further treatment that involves the formation of ionic or covalent bonds with the terminal amine groups on the polyamide fiber, including coloring of the fiber with anionic materials. The stain resistant fiber can be colored or otherwise treated with compounds that bind to the carboxylic acid end groups of the polyamide fiber.

Alternatively, the polyamide fiber can be treated with the isocyanate after it has been manufactured into an article such as carpet or carpet tile. The treatment must be mild enough not to damage any of the materials in the article, including backing materials and adhesives. For example, bitumen backed carpet must be treated at a lower temperature than polyvinyl chloride backed carpet.

The isocyanate is applied in a solution of any suitable concentration, typically between 0.5% to 60% by weight. The preferred weight percent of isocyanate applied to the polyamide, based on the weight of the fiber ranges from 0.5 to 5%, and more typically from approximately 1 to 2%. Isocyanate foams can be applied with very high concentrations of isocyanate. A preferred concentration range for pad squeeze or kiss roll applications is between 0.05 and 100 grams/liter. A more preferred concentration is between 5 and 50 grams/liter. The optimal concentration (in grams/liter) will depend on the molecular weight of the isocyanate. If the isocyanate solution is too dilute, the isocyanate may be applied unevenly. A large wet pick-up (20–300%) is desireable to provide uniform isocyanate treatment.

It is very important that the polyamide fibers be very dry when treated with the isocyanate. Even damp fiber will not react suitably with the isocyanate to provide adequate stain resistance. The isocyanate should be reacted with the fiber for the minimum time period and at the lowest temperature that is effective to complete the reaction. The time and temperature of reaction will depend in part on the reactivity of the isocyanate, and can be determined without undue experimentation. The time of reaction typically ranges from one to sixty minutes. The length of time required for reaction is a function of the intensity and temperature of the heating unit used. A time period of from one to ten minutes is usually sufficient for isocyanate/polyamide reactions in ovens that reach 120° C. or higher. A time and temperature should be selected that allows the isocyanate to react with the terminal amine groups of the polyamide without undesired reaction of the isocyanate with the internal amide linkages of the polyamide. Appropriate temperatures for reaction typically range from 140° F. to 400° F. (60° C. to 205° C.). The carpet and fabric fiber typically should not reach over approximately 140° C. when placed in a heating unit with an air temperature of between 60° C. to 205° C. for the appropriate time period. Aromatic isocyanates in general react faster and under milder conditions than aliphatic isocyanates.

The isocyanate treated fiber can be heated with a wide variety of known means, including conventional ovens, forced air ovens, microwave and infared heaters. When using an isocyanate that reacts slowly with the fiber, or when carrying out the reaction in the absence of a catalyst, it is sometimes desirable to include a post-cure step in which the heat is continued until a low percentage of moisture is achieved.

Catalysts can be used to facilitate the reaction of the isocyanate with the polyamide. Suitable catalysts include organic tertiary amines such as 1,4-diazabicyclo[2.2.2]octane (DABCO), or metallic catalysts such as tin, antimony or other heavy metal compounds.

Typically, the dry fiber is first soaked with the isocyanate solution until saturated, and then the fiber is heated to initiate reaction. It is preferred to heat the fiber to dryness. The length of time and temperature needed to complete the reaction will vary depending on the type of oven used and the air circulation in the oven.

As an example, a nylon yarn can be soaked in an isocyanate solution and heated at 120° C. for 10–15 minutes to impart permanent stain resistance. If desired, the yarn can be washed after treatment to remove excess reactants.

In another example, the isocyanate can be foamed or sprayed onto carpet fiber, and then heated in an oven that is at a temperature ranging from 120° C. to 205° C. for one to ten minutes, typically two to five minutes.

The treatment is very conveniently carried out in an organic such as toluene, tetrachloroethane, tetrahydrofuran, or dimethylformamide. However, due to environmental concerns, it is often desireable to treat the fiber in an aqueous system. If the isocyanate is not water soluble, it can be mixed with a small amount of organic cosolvent such as cyclohexane or dimethylformamide that is then mixed with water. Alternatively, the isocyanate can be applied in an emulsion prepared by methods well known to those of skill in the art. The surfactant used in the emulsion should not contain active hydrogens that will react with the isocyanate. Examples of suitable surfactants include sodium dodecylbenzene sulfonate, and sodium dioctyl sulfosuccinate. Further, certain isocyanates can be made water dispersible by adding hydrophilic groups that do not contain active hydrogens. An example of a water dispersible isocyanate is PBA 2259 from ICI Americas, Inc. MDI can also be purchased in a water dispersible form from the same company.

The present invention can be used to impart permanent stain resistance to all types of nylon fibers, including nylon 6; nylon 6,6; nylon 10,11,12; and copolymer structures that have amino end groups.

As characterized below, the method for treating polyamides with isocyanates to impart stain resistance is applicable to a wide variety of isocyanates and final products.

EXAMPLE 1

Treatment of Nylon 6 yarn with Methylenediphenyl Diisocyanate

Nylon 6 yarn (0.3 g) was dipped into a 1% wt/wt solution of methylenediphenyl diisocyanate (MDI) in toluene for 10 seconds. The yarn was removed and the excess solution allowed to drain off, resulting in a wet pick-up of 158%. The yarn was heated in an oven at 120° C. for 1 hour.

EXAMPLE 2

Treatment of Nylon Carpet Tile with Methylenediphenyl Diisocyanate

A three inch square of carpet tile was placed upside down in a pan containing a 1% wt/wt solution of MDI in toluene. The height of the solution in the pan was sufficient to submerge the tile yarn but not contact the tile backing. The tile was removed from the solution after soaking for 10 seconds, which resulted in a 205% wet pick up based on the weight of the tile yarn. The tile was heated in an oven at 120° C. for 1 hour.

EXAMPLE 3

Treatment of Nylon Carpet Tile with a,a-Dimethyl meta-Isopropenyl Benzyl Isocyanate A three inch square of carpet tile was placed upside down in a pan containing a 2% wt/wt solution of a,a-dimethyl meta-isopropenyl benzyl isocyanate (TMI) in toluene. The height of the solution in the pan was sufficient to submerge the tile yarn but not contact the tile backing. The tile was removed from the solution after soaking for 10 seconds, which resulted in a 220% wet pick up based on the weight of the tile yarn. The tile was heated in an oven at 120° C. for 1 hour.

EXAMPLE 4

Treatment of Nylon 6 Carpet Tile with an Emulsion of Isophorone Diisocyanate and Hexane Diol An emulsion of 2% isophorone diisocyanate (IPDI) is prepared by dissolving 0.5 parts by weight of sodium dodecylbenzene sulfonate in 97.5 parts of water and adding 2 parts of IPDI with continuous stirring. Hexane diol (0.4 parts) is then added to the emulsion. The emulsion is applied to the carpet tile by kiss-roll or pad squeeze. After the excess solution is allowed to drain off, the carpet tile is heated in an oven of forced air at 116° C. for 6–7 minutes.

EXAMPLE 5

Treatment of Nylon Carpet with Emulsion of Isophorone Diisocyanate

A three inch square of carpet tile was placed upside down in a pan containing an emulsion of 2% isophorone diisocyanate (IPDI) made by dissolving 0.5 g of sodium dodecylbenzene sulfonate in 97.5 g of water and adding 2 g of IPDI with continuous stirring. The height of the solution in the pan was sufficient to submerge most of the tile yarn but not contact the tile backing. The tile was removed from the solution after soaking for 10 seconds, which resulted in a 250% wet pick up based on the weight of the tile yarn. The tile was heated in an oven at 120° C. for 1 hour.

EXAMPLE 6

Treatment of Nylon Carpet Tile with PBA 2259

A three inch square of carpet tile was placed upside down in a pan containing a 2% wt/wt solution of PBA 2259 in water. The height of the solution in the pan was sufficient to submerge the tile yarn but not contact the tile backing. The tile was removed from the solution after soaking for 10 seconds, and excess solution drained, resulting in a 140% wet pick up based on the weight of the tile yarn. The tile was heated in an oven at 120° C. for 1 hour.

EXAMPLE 7

Treatment of Nylon Fiber with Oligomer of IPDI and Ethylene Glycol

An emulsion of 2% IPDI is prepared by dissolving 0.5 grams of sodium dodecylbenzene sulfonate in 97.5 grams of water and then adding 2.0 grams of IPDI with continuous stirring. Ethylene glycol (0.4 grams) is then added to this mixture. Nylon 6 yarn (0.3 g) is dipped into the solution for 10 seconds and then removed. The excess solution was then allowed to drain off. The yarn was heated in an oven at 120° C. for 1 hour.

EXAMPLE 8

Treatment of Carpet Tile with IPDI and Hexane Diol

An emulsion of 2% IPDI was made by dissolving 0.25 grams of sodium dodecylbenzene sulfonate in 97.75 grams of water and then adding 2.0 grams of IPDI with continuous stirring. Hexane diol (0.4 grams) was then added to this mixture. A three inch square of carpet tile was placed upside down in a pan containing this emulsion for approximately ten seconds. The height of the solution in the pan was sufficient to submerge most of the tile yarn but not contact the tile backing. The carpet tile sample was then removed, and the excess solution drained off. This procedure resulted in a 240% pick-up. The tile was then heated in an oven for one hour.

EXAMPLE 9

Treatment of Nylon Carpet Tile During Manufacture

After the carpet tile has been assembled and printed, it is passed through an atmospheric steam oven for about eight minutes and then the excess water is vacuumed off. A solution of 2% PBA 2259 in water is then applied to the fiber by kiss roll or pad squeeze. The tile is then heated in a forced air oven at 116° C. for 6–7 minutes.

EXAMPLE 10

Treatment of Nylon Carpet Tile with Isocyanate Spray

After the carpet tile has been assembled, and after overprinting if desired, the nylon fibers are vacuum dried and then sprayed with a solution of 2% IPDI to a wet pick up of 200–250%, and then heated at 240° C. for 6–7 minutes, or until the fibers are completely dry.

EXAMPLE 11

Treatment of Nylon Carpet Tile With Isocyanate Foam

A foam is prepared by whipping a solution of 25 grams of PBA 2259 and 3 grams of sodium dodecylbenzene sulfonate in 72 grams of water. The foam is mechanically worked into the fibers, and then the tile is dried at 120° C.

EXAMPLE 12

Stain Resistance of Isocyanate Treated Nylon Fibers

The stain resistance of isocyanate treated nylon fiber was tested by soaking light gray nylon 6 carpet tiles treated as in Examples 2, 5, and 6, together with an untreated tile, for 24 hours in a cherry Kool-Aid® solution (unsweetened) prepared according to the directions on the package. The samples were rinsed with water for about 10 seconds after soaking and then the extent of staining was determined. The results are provided in Table 1.

TABLE 1

Stain Resistance of Isocyanate Treated Nylon Carpet Tiles

| Sample | Staining |
|---|---|
| Untreated carpet | Bright red |
| Carpet Tile of Example 2 | No stain |
| Carpet Tile of Example 5 | Light pink tint |
| Carpet Tile of Example 6 | No stain |
| Carpet Tile of Example 8 | Very light pink tint |

As indicated in Table 1, treatment with methylene diphenyl diisocyanate (Examples 2 and 6) provides excellent protection to nylon fiber against staining by acid dyes. Isophorone diisocyanate (Example 5) as well as a mixture of Isophorone diisocyanate and hexane diol (Example 8) also provides superior protection against acid dyes. The data in Table 1 illustrates the general observation that aromatic isocyanates typically provide better stain resist treatment to nylon fibers than aliphatic isocyanates.

EXAMPLE 13

Permanence of Isocyanate Stain Resist Treatment

Nylon carpet tile samples prepared as described in Examples 2, 5, and 7, as well as a sample of residential shag Cabin Craft carpet (style A3-55 Comfort) treated with Du Pont's Stainmaster® formulation (a sulfonated formaldehyde condensation polymer in combination with a fluorocarbon coating), a sample of light gray nylon carpet tile treated with a sulfonated aromatic condensation polymer (SAC, purchased from Grifftex Inc.) alone, and a sample of carpet treated with BASF Scotchgard® (a fluorochemical treatment) were washed five times under identical conditions using a 1% aqueous solution of AATCC standard detergent #124 with a typical residential washing machine. The samples were then soaked for 24 hours in cherry Kool Aid®, rinsed with water, and then analyzed for extent of staining. The results are provided in Table 2.

TABLE 2

Comparison of Permanence of Stain Resist Treatments

| Sample | Staining |
|---|---|
| Before Washing | |
| SAC Treated | No stain |
| From Examples 2 and 7 | No stain |
| From Example 5 | Light pink tint |
| StainMaster® (Du Pont) | No stain |
| BASF Scotchgard® | Red |
| After Washing | |
| SAC Treated | Bright red |
| From Examples 2 and 7 | Almost undetectable |
| From Example 5 | Light pink tint |
| StainMaster® (Du Pont) | Pink |
| BASF Scotchgard® | Bright red |

As indicated in Table 2, carpet tile samples treated as described in Examples 2, 5, and 7 retain their stain resistance after five washings. The SAC treated nylon carpet sample completely lost its stain resistance after five washings. The StainMaster ® treated sample lost significant stain resistance after washing, however, the fluorochemical coating appeared to prolong the effectiveness of the treatment. The fluorochemical coating would have the same effect on isocyanate treated polyamide fibers. Further, as indicated above, the fluorochemical coating alone (Scotchgard) provides no protection from staining.

VI. Use of Other Organic Compounds to Impart Permanent Stain Resistance to Polymers with Terminal Amine Groups Polymeric fibers with terminal amine groups can be made permanently stain resistant by reacting the polymer with a carboxylic acid or its derivative that covalently binds with the amine. Examples of suitable carboxylic acid derivatives include acid chlorides, acid anhydrides, and esters. Acid chlorides are generally less preferred than isocyanates because they have a very strong odor and are highly reactive in water. The byproduct of the reaction of an acid chloride with water is hydrochloric acid. Therefore, when using an aromatic acid chloride in an aqueous system, a base should be added to neutralize the acid generated.

Alternatively, the terminal amine can be reacted with a sulfonyl chloride, sulfonyl amide, sulfonyl isocyanate, or acyl isocyanate. Sulfonyl isocyanates and acyl isocyanate are preferably applied in an organic solvent because they are typically too reactive to be used in an aqueous system.

EXAMPLE 13

Treatment or Nylon Fibers with Benzoyl Chloride

Two percent wt/wt solutions of benzoyl chloride in toluene and water (containing 1% sodium bicarbonate) were prepared. Nylon 6 carpet tile samples were separately soaked at room temperature for about two minutes in the two solutions (wet pick-up 150% and 250%, respectively) and then dried at 120° C. The samples were then placed in cherry Kool-Aid ® for two hours and rinsed. The solvent treated sample had only a very slight staining, whereas the aqueous treated sample had only moderate staining. The control was intensely stained.

EXAMPLE 14

Treatment of Nylon Fibers with Carboxylic Acid Anhydrides

Two percent solutions of succinic anhydride (SA) and phthalic anhydride (PA) in dimethylformamide (DMF) were prepared. Two percent emulsions of each were also prepared using a small amount of DMF (4% wt/wt for SA and 6% wt/wt for PA) and 0.3% wt/wt of Siponate DS-10 (sodium dodecylbenzene sulfonate, purchased from Alcolac, Inc., Baltimore, Md.) in water. Nylon 6 carpet tile samples were separately soaked in these solutions and then dried for about one hour at 120° C. The samples, along with a control and a sample of carpet treated with a,a-dimethyl meta-isopropenyl benzyl isocyanate (TMI) were then soaked in cherry Kool-Aid ® for 24 hours and allowed to dry. The results are provided in Table 3. As indicated, the isocyanate (TMI) provides better resistance to acid dyes than the anhydrides in aqueous systems, however, the reverse is true in solvent systems.

TABLE 3

Stain Resistance of Nylon Fibers Treated with Acid Anhydrides

| | Water | DMF | TMI | SA | PA | DS-10 |
|---|---|---|---|---|---|---|
| Sample 1 | 94 g | 4 g | 2 g | — | — | 0.3 g |
| Sample 2 | 98 g | — | 2 g | — | — | 0.3 g |
| Sample 3 | 94 g | 4 g | — | 2 g | — | 0.3 g |
| Sample 4 | 92 g | 6 g | — | — | 2 g | 0.3 g |
| Sample 5 | — | 98 g | — | 2 g | — | — |
| Sample 6 | — | 98 g | — | — | 2 g | — |

| Sample | Staining |
|---|---|
| 1 | Slight |
| 2 | Slight (but better than sample 1) |
| 3 | Slight - moderate |
| 4 | Moderate (PA didn't emulsify well) |
| 5 | Very slight |
| 6 | Very slight |
| Control | Intense |

VII. Application of a Fluorochemical Coating to Isocyanate Treated Polyamide Fiber The stain resisting performance of polyamide fibers treated with an isocyanate can be improved by applying a fluorochemical coating to the treated fiber. Examples of suitable fluorochemical coatings include Scotchgard ® 358 and 352 (Minnesota Mining & Mfg. Co.); Zepel ® and Teflon ® Toughcoat (E. I. Du Pont Nemours & Co.); Milease F-86, manufactured by ICI Americas, Inc.; Aurapel FC-340 and 342, manufactured by Auralux Corporation; NK Guard FG280, manufactured by NICCA Chemicals; and Glo-Guard CFC, manufactured by Glo-Tex Chemicals.

The amount of fluorochemical required to provide a coating that cannot be penetrated by water will vary depending on the particular fluorochemical used. Methods for applying fluorochemical coatings are known to those skilled in the art, and are described in a number of patents, including U.S. Pat. No. 4,619,853 to Blythe, U.S. Pat. No. 4,388,372 to Champameria, U.S. Pat. No. 4,839,212 to Blythe, et al., and U.S. Pat. No. 4,680,212 to Blythe, et al., all of which are incorporated herein by reference.

If desired, an antimicrobial compound or combination of compounds can be added to the fluorochemical coating. Examples of antimicrobial compounds that can be included in the coating include OBPA (10,10'-oxybisphenarsine), marketed under the name Vinyzene BP-505 DOP by Morton Thiokol, Inc.; silicone quaternary ammonium salts such as Sylgard, manufactured by Dow Corning Corporation; and monoesters of phosphoric acid or its salt, preferably the di(2-hydroxyethyl)cocoamine salt of 2-ethylhexylphosphoric acid, as described in U.S. Ser. No. 07/047,561, filed Apr. 27, 1987, entitled "Microbiocidal Composition and Method of Preparation Thereof," now U.S. Pat. No. 4,935,232, and incorporated herein by reference.

The fluorochemical used to coat the stain treated fibers can also be mixed with other polymers or monomers to increase its effectiveness, including polymethylmethacrylate.

Modifications and variations of the present invention of permanent stain resistant treatment for polyamide fibers will be obvious to those of skill in the art from the foregoing detailed description of the invention. Such modifications and variations are intended to come within the scope of the appended claims.

We claim:

1. A method for imparting stain resistance to a polyamide carpet or fabric fiber comprising:

contacting the dried fiber with approximately 0.5 to 5% by weight based on the weight of the fiber of isocyanate, and then heating the fiber to a temperature of less than 140° C. for a time period of less than one hour, to react the isocyanate with terminal amine groups of the polyamide to form terminal urea groups, without substantial reaction between the isocyanate and the internal amide linkages of the polyamide fiber, wherein said minimum heating temperatures and times are sufficient to impart said desired stain resistance.

2. The method of claim 1 wherein the polyamide fiber is nylon.

3. The method of claim 1 wherein the isocyanate is selected from the group consisting of monoisocyanate, diisocyanate, polyisocyanates, and polymers containing isocyanate functional groups.

4. The method of claim 1 wherein the isocyanate is selected from the group consisting of 4,4'-diphenylmethane-diisocyanate, isophorone diisocyanate, a,a-dimethyl meta-isopropenyl benzyl isocyanate, toluene diisocyanate, and tetramethyl xylene diisocyanate.

5. The method of claim 1 further comprising applying the isocyanate as an emulsion.

6. The method of claim 1 wherein the isocyanate is water dispersible.

7. The method of claim 1 further comprising dyeing the fiber before the stain resist treatment.

8. The method of claim 7 wherein the dye is an acid dye.

9. The method of claim 1 further comprising dyeing the fiber after the stain resist treatment.

10. The method of claim 9 wherein the dye is a basic dye.

11. The method of claim 1 further comprising applying a fluorinated organic compound or polymer to the fiber after isocyanate treatment.

12. The method of claim 1 wherein the isocyanate treated fiber is heated in a heating unit that is at a temperature of between approximately 60° C. and 205° C.

13. The method of claim 1, wherein between approximately 1 and 2 weight percent of isocyanate is applied to the fiber, based on the weight of the fiber.

14. The method of claim 1 further comprising heating the isocyanate treated fiber for a time ranging from one minute to ten minutes.

15. The method of claim 14 wherein the isocyanate is applied to the fiber in an emulsion or dispersion.

16. The method of claim 1, wherein the isocyanate is applied in a concentration range of from 0.5% to 60% by weight.

17. The method of claim 1 wherein the isocyanate is applied to the fiber in combination with a blocking compound to form a precursor.

18. The method of claim 17 wherein the blocking compound is selected from the group consisting of alcohols, phenols, lactams, active methylenes, mercaptans, amides, imides, amines, imidazoles, ureas, carbonates, imines, oximes and sulfites.

19. The method of claim 17 wherein the precursor generates the isocyanate on heating.

20. The method of claim 17 wherein the precursor generates the isocyanate on chemical treatment.

21. The method of claim 18 wherein the blocking compound is selected from the group consisting of ethylene glycol and hexane diol.

22. The method of claim 1 wherein the isocyanate is applied by spraying the fiber with the isocyanate solution.

23. The method of claim 1 wherein the isocyanate is applied by dipping the fiber in the isocyanate solution.

24. The method of claim 1 wherein the isocyanate is applied by soaking the fiber in the isocyanate solution.

25. The method of claim 1 wherein the isocyanate is applied in a foam.

26. The method of claims 17 wherein the isocyanate precursor is prepared by the reaction of an amine with an isocyanate.

27. The method of claim 1, wherein the fiber is incorporated into an article before treatment.

28. The method of claim 1 wherein the polyamide fiber is treated before incorporation into an article.

29. A method for imparting stain resistance to nylon carpet or carpet tile comprising contacting the dried carpet or carpet tile with approximately 0.5 to 5% by weight based on the weight of the carpet fiber of isocyanate, and then heating the fiber to a temperature of less than 140° C. for a time period of less than one hour, to react the isocyanate with terminal amine groups of the polyamide to form terminal urea groups, and without reacting the isocyanate with internal amide linkages of the polyamide fiber, wherein said minimum heating temperatures and times are sufficient to impart said desired stain resistance.

30. The method of claim 29, further comprising applying the isocyanate by foam or spray.

31. A stain resistant polyamide carpet or carpet tile prepared by:

contacting the dried carpet fiber with approximately 0.5 to 5% weight based on the weight of the fiber of isocyanate, and then heating the fiber to a temperature of less than 140° C. for a time period of less than one hour, to react the isocyanate with terminal amine groups of the polyamide to form terminal urea groups, and without reacting the isocyanate with internal amide linkages of the polyamide fiber, wherein said minimum heating temperatures and times are sufficient to impart said desired stain resistance.

32. The carpet or carpet tile of claim 31, wherein the fibers are treated before the carpet is assembled.

33. The carpet or carpet tile of claim 31, wherein the fibers have been heated to a temperature of approximately less than 120° C.

34. The carpet or carpet tile of claim 31, wherein the fibers have been treated for a length of time of approximately between one and ten minutes.

35. The carpet or carpet tile of claim 34, wherein the carpet or carpet tile is dried completely before application of the isocyanate.

36. The carpet or carpet tile of claim 31, wherein the isocyanate is selected from the group consisting of monoisocyanate, diisocyanate, polyisocyanates, and polymers that include isocyanate functional groups.

37. The carpet or carpet tile of claim 31 wherein the isocyanate is selected from the group consisting of 4,4'-diphenylmethane-diisocyanate, isophorone diisocyanate, a,a-dimethyl meta-isopropenyl benzyl isocyanate, toluene diisocyanate, and tetramethylxylene diisocyanate.

38. The carpet or carpet tile of claim 31, further comprising a fluorochemical coating.

* * * * *

UNITED STATES PATENT AND TRADEMARK OFFICE

CERTIFICATE OF CORRECTION

PATENT NO. : 5,252,375

DATED : October 12, 1993

INVENTOR(S) : Albin F. Turbak, Rodney A. Smith, Chung-Hsien Zah

It is certified that error appears in the above-indentified patent and that said Letters Patent is hereby corrected as shown below:

Column 4, line 47, delete "R-N=C=O + R′—NH2" and insert
- - R-N=C=O + R′ — NH2 - -

Column 9, line 42, after "organic" insert - - solvent - -

Column 13,line 36, Example 13, delete "or" and insert - - of - -

Column 16, line 36, Claim 31, after "5%" insert - - by - -

Signed and Sealed this

Fifth Day of August, 1997

Bruce Lehman

*Attest:*

BRUCE LEHMAN

*Attesting Officer*

*Commissioner of Patents and Trademarks*